United States Patent [19]

Viesturs et al.

[11] Patent Number: 4,534,078

[45] **Date of Patent: * Aug. 13, 1985**

[54] BODY SUPPORTING MATTRESS

[75] Inventors: Eric A. Viesturs; Gundar E. Viesturs, both of Southbury, Conn.

[73] Assignee: Connecticut Artcraft Corp., Naugatuck, Conn.

[ * ] Notice: The portion of the term of this patent subsequent to Dec. 27, 2000 has been disclaimed.

[21] Appl. No.: 543,143

[22] Filed: Oct. 18, 1983

[51] Int. Cl.[3] ..... A47C 27/08; A61G 7/04

[52] U.S. Cl. ..... 5/452; 5/451; 5/455

[58] Field of Search ..... 5/451, 452, 450, 449, 5/455, 457, 441

[56] References Cited

U.S. PATENT DOCUMENTS

| | | | |
|---|---|---|---|
| 2,842,783 | 7/1958 | Druck | 5/457 |
| 3,670,347 | 6/1972 | Weinstein | 5/451 |
| 3,735,432 | 5/1973 | Kreten et al. | 5/451 |
| 4,115,885 | 9/1978 | Davis | 5/451 |
| 4,193,151 | 3/1980 | Calleance | 5/452 |
| 4,389,742 | 6/1983 | De Witt | 5/451 |
| 4,405,129 | 9/1983 | Stuckey | 5/451 |
| 4,422,194 | 12/1983 | Viesturs et al. | 5/451 |

FOREIGN PATENT DOCUMENTS

| | | | |
|---|---|---|---|
| WO81/01792 | 7/1981 | PCT Int'l Appl. | 5/451 |

OTHER PUBLICATIONS

Ardo TM Flotation System; an article on p. 112 of the Jul. 1983 issue of "Flotation Sleep Industry".

*Primary Examiner*—Alexander Grosz

[57] ABSTRACT

A mattress employs a first plastic unit which is flat and horizontal and is provided with a peripherally disposed horizontal endless hollow tube which is inflatable. The tube, when inflated, defines a raised peripheral border surrounding and enclosing an inner flat horizontal central area of the first unit. A second plastic unit is removably disposed on top of the central area. The second unit has a first upper section having oppositely disposed inner and outer surfaces, the outer surface being disposed above the inner surface and permanently defining a plurality of closely spaced raised regions which are interconnected by channels disposed below the top surfaces of the regions. The inner surface permanently defines a like plurality of deep recesses, each deep recess constituting the inside of a corresponding region, the deep recesses being interconnected by shallow recesses, each shallow recess constituting the inside of a corresponding channel. The second unit has a second lower section which is essentially flat and horizontal and is sealed to the inner surface of the first section in such manner that the deep and shallow recesses communicate with each other.

3 Claims, 6 Drawing Figures

BODY SUPPORTING MATTRESS

BACKGROUND OF THE INVENTION

Bedridden patients who have to maintain a substantially motionless position for prolonged periods of time develop bedsores on the skin. These sores, referred to in medical terms as Decubitus Ulcers, are painful, hard to heal, and create conditions for further infection. Ulcer formations of this type are produced in most cases because the pressure exerted upon the skin surfaces under the bony prominences of the patient which bear most of the weight of the patient when the body of the patient presses against the ordinary mattress or other body support and obstructs the circulation of blood in the capillaries directly under these surfaces.

It is known that large, very deep water filled containers (waterbeds) of large size and weight permit the patient to float freely in such a manner that the pressure exerted upon the weight bearing surface of the patient's body is distributed uniformly, eliminating regions of high pressure under the bony prominences whereby the ulcers do not form. These large waterbeds are covered with a top plastic sheet free of tension. The patient, placed upon this sheet, does not get wet but effectively floats deep in water. However, waterbeds of such depth are much too large and too costly for general use.

When the depth and the size of the waterbed are both reduced to more convenient and smaller dimensions, as is done with the light weight water flotation mattresses, the upper surface of the mattress upon which the body is placed is subjected to a tension or stretch force which produces undue pressure against the skin, in particular under the bony prominences. The patient does not float in the same manner as in a waterbed because the body is supported by a combination small buoyancy force and more dominant stretch force in the upper plastic sheet that is supporting the body. In the ideal situation using a water bed, the downwardly directed weight of the patient's body at any point along the body is counterbalanced by a force directed vertically upward by the buoyancy forces of water alone. The plastic sheet in such a case under the body of the patient and above the water is free to adjust to the contour of the patient causing no pressure whatsoever. Such an arrangement provides the best conditions for prevention of bedsores. However, when the sheet is not free to adjust, as in the case of a small light weight water mattress, the skin area supporting body weight is reduced, the depth of flotation is decreased, and most of the counterbalancing, body supporting force is derived from the stretch in the top sheet of the mattress caused by the height of the water. As the surface is depressed in accordance with the body contour and weight of the patient, unequal forces are transmitted via the surface stretch tension of the mattress. As a result regions of high pressure are created, mainly under the bony prominences, compressing the underlying capillaries, causing obstruction of blood circulation as previously described.

Another type of small size mattress has been developed to deal with the problems of bedsores formation. This type of mattress is adapted to be filled with air. The whole surface of the mattress is divided in small parallel chambers, or regions, tied together in two side by side groups. When one of the groups is inflated, the other adjacent group is deflated, providing at all times an area for the body that is not resting on the mattress, but is almost completely relieved from pressure. The adjacent groups of cells are alternatively inflated and deflated producing a massaging action.

Such air mattresses are not as effective as water filled mattresses in inhibiting ulcer formation.

This inferior performance is inherent in the geometry because the air pressure in the inflated region is more than twice as high as it would be if the entire mattress were to be completely inflated because more than half of the skin area is excluded from participating in supporting the total body weight. The massaging action ameliorates but does not fully eliminate the adverse effects of localized high pressures.

In copending application Ser. No. 295,504, filed 4/24/81, now U.S. Pat. No. 4,422,194 there is disclosed a new type of body support that can be used with water or air. This support employs a first plastic section having oppositely disposed inner and outer surfaces. The outer surface is disposed above the inner surface and permanently defines a plurality of closely spaced raised regions of like size and contour which are interconnected by channels disposed below the walls of the regions. The inner surface of the first section permanently defines a like plurality of deep recesses, each deep recess constituting the inside of a corresponding region. The deep recesses are interconnected by shallow recesses, each shallow recess constituting the inside of a corresponding channel.

A second plastic section is sealed to the inner surface of the first section in a manner in which said deep and shallow recesses communicate with each other. A flexible hollow tube is disposed around the periphery of said sections and is secured thereto. The tube has an outer wall with openings which connect the tube interior to said shallow recesses. The tube and sections are sealed to each other in a leak-proof manner to prevent leakage of air or water between the interior of the tube and sections and the outside thereof.

This combination of tubes and sections thus has a hollow interior with deep and shallow recesses and tube interior being interconnected. In use, the interior is completely filled with water or air.

When a patient sits upon the device, as, for example, when the patient is on a wheel chair, or when the patient lies upon the device of larger size when it is used as a mattress, the various raised regions conform independently without stretch tension to the body contour and, because of the intercommunicating hollow regions, the shallow channels and tube distribute the water or air as required. As the patient shifts in bodily position, the water or air movement adjusts the shape of the device accordingly.

The raised regions are depresed when conforming to the body contour and spread sideways to close the gaps therebetween, thus providing a continuous support between the spread regions and the body of the patient. Unlike the prior art devices, the top portions of the raised regions are not subjected to appreciable stretch-tension forces since the tube substantially eliminates sideways deformation of the raised regions which would otherwise produce such forces with the resultant adverse effects previously described. The use of the tube filled with water or air permits the raised regions that are not underneath the body to remain upright whereby the surface stretch in the rest of the raised regions under the body stretch-tension is minimized, and the pressure on the skin is also minimized, thus minimizing ulcer formation.

The present invention is based upon the discovery that the tube and section structure described in the aforementioned copending application can be made even more effective in reducing ulcer formation when the central sections are water filled and at the same time the peripheral tube is filled with air. Moreover, this combined use of an air filled tube and water filled sections enables a new type of mattress which is relatively inexpensive to manufacture and which, as compared to other water filled mattresses, is considerably more effective and is easier to install or remove.

Summary of the Invention

A body support mattress, in accordance with the present invention, comprises a first plastic unit which is flat and horizontal. The first unit is provided with a peripherally disposed horizontal endless hollow tube which is inflatable. Said tube, when inflated, defines a raised peripheral border surrounding and enclosing an inner flat horizontal central area of the first unit.

The mattress also comprises at least one second plastic unit which is removably disposed on top of said central area. Said second unit has a first upper section having oppositely disposed inner and outer surfaces. The outer surface is disposed above the inner surface and permanently defines a plurality of closely spaced raised regions which are interconnected by channels disposed below the top surfaces of the regions. The inner surface permanently defines a like plurality of deep recesses, each deep recess constituting the inside of a corresponding region. The deep recesses are interconnected by shallow recesses. Each shallow recess constitutes the inside of a corresponding channel. Said second unit has a second lower section which is essentially flat and horizontal and is sealed to the inner surface of the first section in such manner that the deep and shallow recesses communicate with each other.

In use, the first unit is placed upon a bed and the tube is inflated with air and becomes hard. The second unit is placed on top of the central area of the first unit and is filled with water. The air filled tube is more compressible than the same tube when filled with water whereby when the water filled second unit presses against the hard air filled tube, the stretch tension forces are reduced even further than the reduction obtainable by use of a single unit mattress utilizing water filled deep and shallow recesses interconnected to the interior of a water filled tube.

In addition, the two units are easily installed and removed and can be separately and easily cleaned and maintained.

DETAILED DESCRIPTION OF PREFERRED EMBODIMENTS

Figure 1:
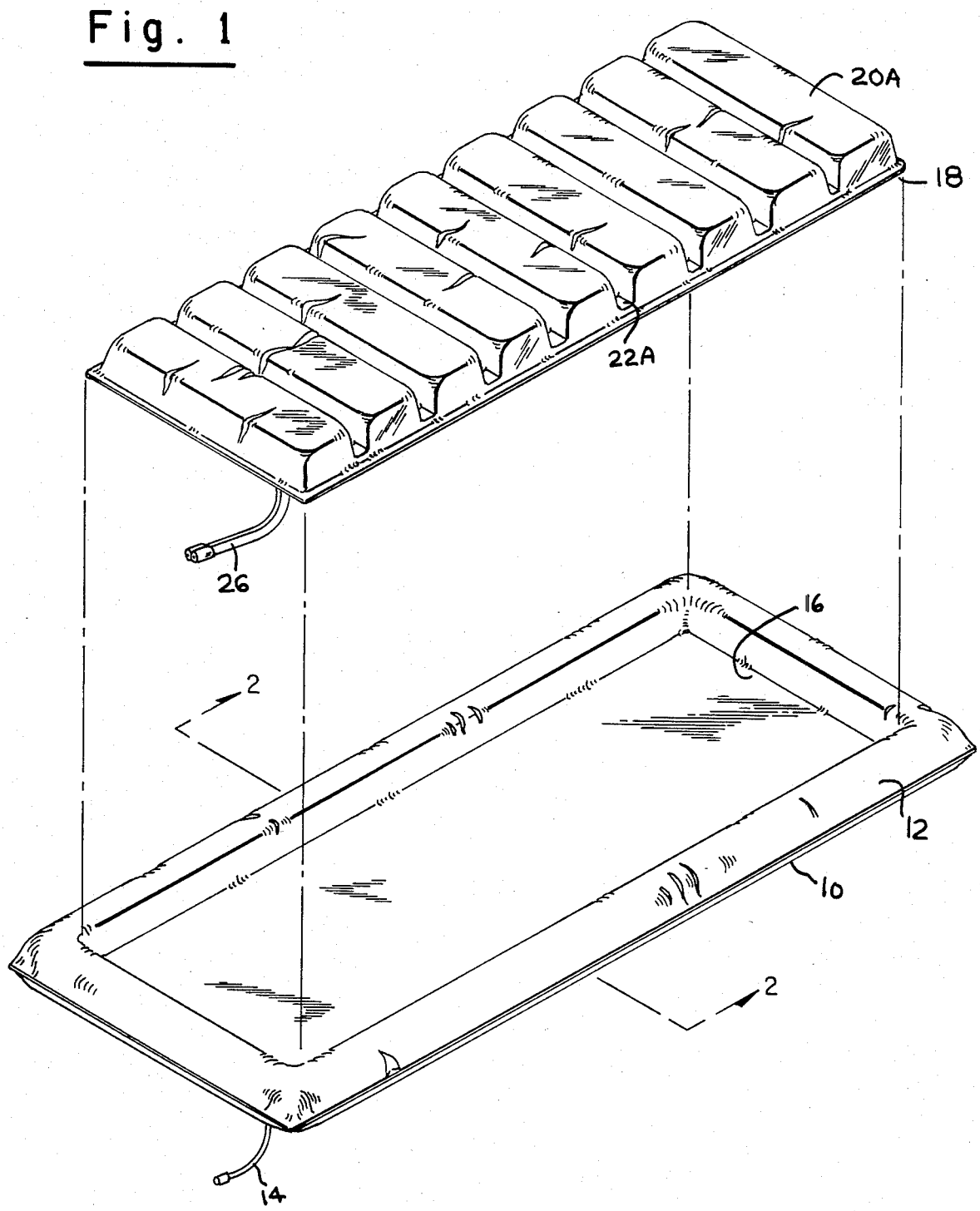
FIG. 1 is an exploded perspective view of the invention.
Figure 2:
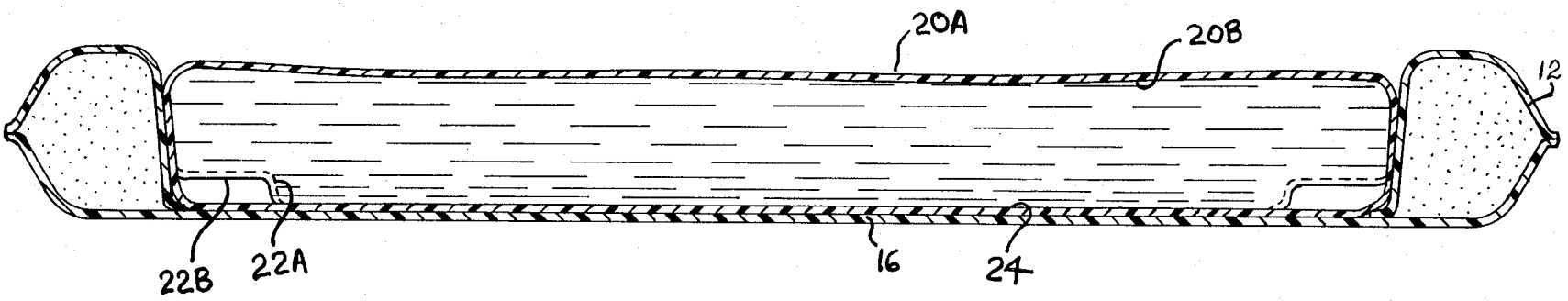
FIG. 2 is a cross sectional view taken along line 2—2 in FIG. 1.
Figure 3:
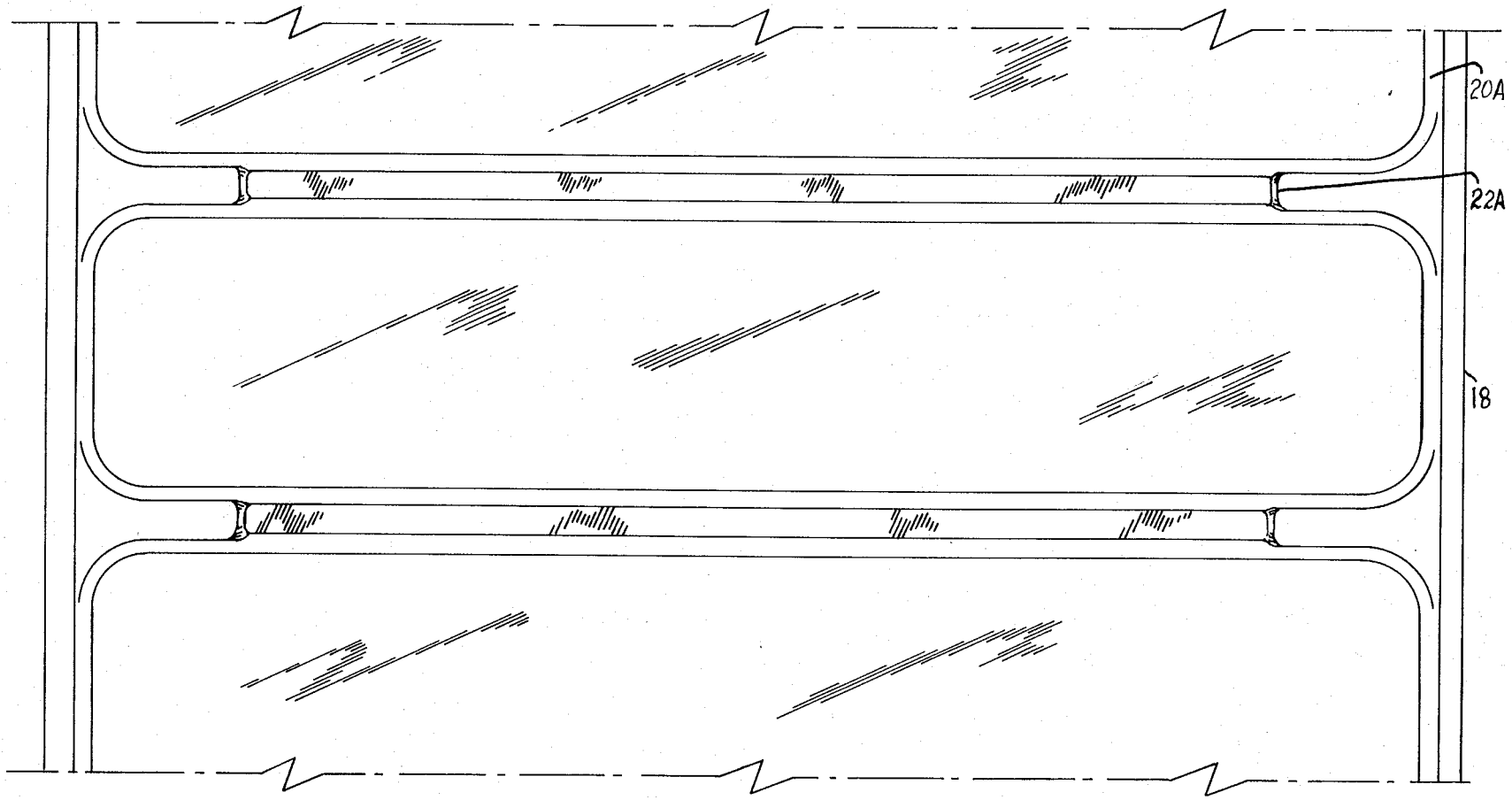
FIG. 3 is a detail top view of a portion of the removable water filled unit shown in FIGS. 1 and 2.

Referring now to FIGS. 1–3 a first plastic unit 10 is flat, horizontal and flexible. It is rectangular in shape. Unit 10 has a peripherally disposed integral horizontal endless hollow tube 12 which can be inflated with air via hose 14. This tube when inflated defines a raised peripheral rectangular border surrounding and enclosing an inner flat horizontal centrally disposed rectangular area 16. Conventional manually sealable ports (not shown) permit the air in the tube to be expelled when the tube is manually compressed.

A second plastic unit 18 is rectangular in shape and is adapted to be removably disposed on area 16. Unit 18 has a first upper section with oppositely disposed inner and outer surfaces. The outer surface is disposed above the inner surface and defines a plurality of closely spaced raised regions 20A of like size and contour (in this example these regions 20A are rectangularly shaped with opposite ends abutting tube 12) which are interconnected by channels 22A disposed below the top surfaces of the regions 20A and extending above the bottom level of the outer surface. The inner surface contains a like plurality of deep recesses 20B, each recess 20B being the underside of the corresponding raised region 20A. The deep recesses 20B are interconnected by shallow recesses 22B, each shallow recess being the inside of a corresponding channel 22A. The unit 18 has a second lower flat section 24 which is sealed to the upper section whereby the shallow and deep recesses communicate with each other. These recesses can be filled with water via hose 26. The lower section has manually sealable conventional drain ports (not shown) which allow the water to drain out.

For ease of use, unit 18 shown as a single unit can be replaced by two or more units of smaller size which can be abutted end to end on top of the area 16. Each such unit can be self contained and can be filled with water or drained of water independently of the other.

The units are produced by vacuum forming.

It will be seen from the drawings that the vertical height of the tube above area 16 is greater than the vertical height of regions 20A above area 16.

In use the patient lies on the second unit or units with shoulders touching the tube. The increased height of the tube when inflated relative to that of the raised regions when the second unit is filled with water acts as a body movement restricting and stabilizing cushion as well as a barrier to unexpected movement of the patient who could otherwise accidentally roll off the mattress. The increased height of the tube assists in further minimizing ulcer formation by further minimizing the stretch tension forces in the body supporting surfaces of the water filled second unit.

Figure 4C:
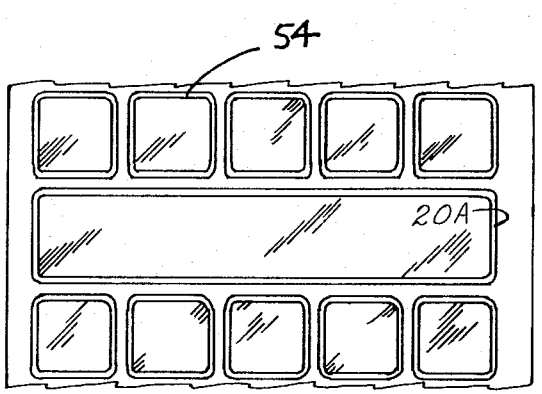
FIGS. 4*a–c* are plan views illustrating various modifications of a portion of the structure shown in FIGS. 1–3.
Figure 4B:
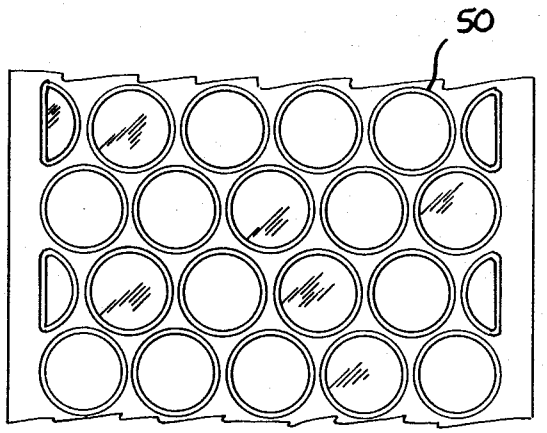
Figure 4A:
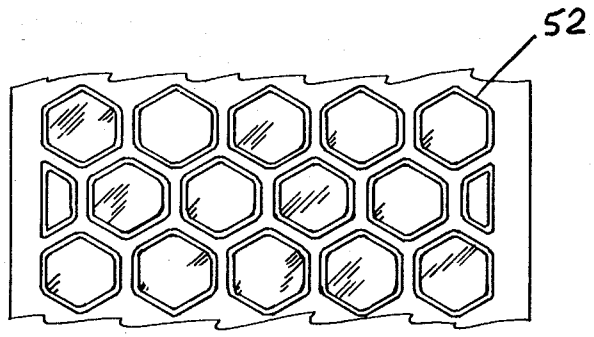

The closely spaced raised regions shown in FIGS. 1–3 are of like size and contour. However, this need not be the case since regions of different size and contour can also be used. As shown for example in FIG. 4 wherein regions can be cylindrical as shown at 50 or polygonal as shown at 52 or square as shown at 54 or combinations of various shapes and sizes.

What is claimed is:

1. A body supporting mattress which, when used by bedridden patients, minimizes formation of decubitis ulcers, said mattress comprising:

a first plastic unit which is flat and horizontal and is adapted to be placed upon a bed, said first unit being provided with a peripherally disposed horizontal endless hollow air filled inflatable tube, said tube defining a raised peripheral border surrounding and enclosing an inner flat horizontal central area of the first unit, said tube being hard when filled with air and having a first vertical height above said central area; and at least one second plastic unit which is removably disposed on top of said central area, said second unit having an upper section having oppositely disposed inner and outer surfaces, the outer surface being disposed above the inner surface and permanently defining a plurality of closely spaced raised regions which are interconnected by channels disposed below the top surfaces of the regions, the inner surface permanently defining a like plurality of deep recesses, each deep recess constituting the inside of a corresponding region, the deep recesses being interconnected by shallow recesses, each shallow recess constituting the inside of a corresponding channel, said second unit having a lower section which is essentially flat and horizontal and is sealed to the inner surface of the first section in such manner that the deep and shallow recesses communicate with each other but do not communicate with said tube, said deep and shallow recesses being filled with water, said raised regions having a second vertical height above said central area, the second height being lower than said first height, the water filled regions and channels being softer than said air filled tube.

2. The mattress of claim 1 wherein each of said regions has two opposite ends and wherein at least one end of each region abuts said tube.

3. The mattress of claim 2 wherein each channel extends for a short distance between adjacent raised regions and is disposed adjacent said tube.

* * * * *